US005520136A

United States Patent [19]

Yamaguchi et al.

[11] Patent Number: 5,520,136

[45] Date of Patent: May 28, 1996

[54] SEARCHING BOAT CAPABLE OF SEARCHING AREA OF SPILLAGE OIL ON THE SEA

[75] Inventors: Takayuki Yamaguchi, Tokyo; Yasuhiro Senga, Shizuoka; Atsushi Sakuma, Kanagawa, all of Japan

[73] Assignee: NEC Corporation, Tokyo, Japan

[21] Appl. No.: 388,403

[22] Filed: Feb. 14, 1995

[30] Foreign Application Priority Data

Feb. 14, 1994 [JP] Japan ..... 6-016902

[51] Int. Cl.[6] ..... B63B 35/00

[52] U.S. Cl. ..... 114/270; 210/103; 210/923

[58] Field of Search ..... 114/270; 210/103, 210/122, 242.3, 747, 923

[56] References Cited

FOREIGN PATENT DOCUMENTS 3-165689 7/1991 Japan .

*Primary Examiner*—Jesus D. Sotelo

*Attorney, Agent, or Firm*—Sughrue, Mion, Zinn, Macpeak & Seas

[57] ABSTRACT

In a searching boat having a searching system for searching a spillage oil on the sea, the searching system comprises a driving device, an oil film appreciating device, and a radio transmitter. The driving device drives the searching boat in a predetermined direction on the spillage oil on the sea. The oil film appreciating device appreciates an edge of an oil film of the spillage oil to produce an oil edge appreciating signal. Supplied with the oil edge appreciating signal, the radio transmitter produces an arrival signal. The driving device may drive the searching boat in a forward direction as a forward mode driving when supplied with a start signal and may drive the searching boat in a backward direction opposite to the forward direction as a backward mode driving when supplied with the oil edge appreciating signal. Furthermore, the driving device may carry out the forward and the backward mode drivings every time when supplied with the oil edge appreciating signal. First through N-th driving devices may drive first through N-th searching boats in first through N-th directions, respectively.

44 Claims, 6 Drawing Sheets

SEARCHING BOAT CAPABLE OF SEARCHING AREA OF SPILLAGE OIL ON THE SEA

BACKGROUND OF THE INVENTION

This invention relates to a searching boat and a method for searching a spillage oil on the sea.

A conventional method of searching a spillage oil is described in Japanese Unexamined Patent Prepublication (Kōkai) No. 165689/1991. This conventional method comprises a first step of preparing first through N-th buoys having transmitters, weights, and resistive boards, respectively, the first through the N-th buoys having first through N-th form rates of upper portions and lower portions relative to draft levels of the first through the N-th buoys, respectively, where N represents an integer greater than two, the first through the N-th form rates being consecutively increased by a constant value between 0.7 and 1.1, both inclusive; a second step of dropping the first through the N-th buoys on an oil film of a spillage oil on the sea, a third step of preparing a direction finding device and a distance measuring device in a searching ship or a searching plane; a fourth step of receiving, in the direction finding device, transmitted signals from the transmitters to find directions of the first through the N-th buoys relative to the direction finding devices; and a fifth step of receiving, in the distance measuring device, to measure distances from the first through the N-th buoys to the distance measuring device.

In this conventional method, one of the first through the N-th buoys has a buoy speed which is approximately equal to a speed of the oil film of the spillage oil. As a result, this conventional method is capable of searching the spillage oil on the sea.

However, inasmuch as, in this conventional method, only one of the first through the N-th buoys has the buoy speed which is approximately equal to the speed of the oil film of the spillage, namely, this conventional method is incapable of detecting edges of the oil film, this conventional method is incapable of searching an area of the oil film of the spillage oil on the sea.

SUMMARY OF THE INVENTION

It is therefore an object of the invention to provide a searching boat and a method which are capable of searching an area of an oil film of a spillage oil on the sea.

Other objects of this invention will become clear as the description proceeds.

According to a first aspect of this invention, there is provided a searching boat having a searching system for searching a spillage oil on the sea. The searching system comprises (A) a driving device for driving the searching boat in a predetermined direction on the sea; (B) an oil film appreciating device for appreciating an edge of an oil film of the spillage oil on the sea to produce an oil edge appreciating signal; (C) a radio transmitter connected to the oil film appreciating device for transmitting an arrival signal when the radio transmitter is supplied with the oil edge appreciating signal; and (D) an electric power device connected to the driving device, the oil film appreciating device, and the radio transmitter.

According to a second aspect of this invention, there is provided a searching boat having a searching system for searching a spillage oil on the sea. The searching system comprises (A) a driving device for driving the searching boat in a forward direction on the sea as a forward mode driving when the driving device is supplied with a start signal and for driving searching boat in a backward direction opposite to the forward direction on the sea as a backward mode driving when the driving device is supplied with an oil edge appreciating signal, the driving device further alternatingly carrying out the forward mode driving and the backward mode driving every time when the driving device is supplied with the oil edge appreciating signal; (B) an oil film appreciating device for appreciating an edge of an oil film of the spillage oil on the sea to produce the oil edge appreciating signal; (C) a radio transmitter connected to the oil film appreciating device for transmitting an arrival signal when the radio transmitter is supplied with the oil edge appreciating signal; and (D) an electric power drive connected to the driving device, the oil film appreciating device, and the radio transmitter to supply the start signal to the driving device.

According to a third aspect of this invention, there is provided a method which searches a spillage oil and which comprises the steps of (A) preparing first through N-th searching boats having searching systems which comprise driving devices, oil film appreciating devices, radio transmitters connected to the oil film appreciating devices, and electric power devices, respectively, where N represents an integer greater than two, the driving devices driving the first through the N-th search boats in first through N-th directions on the sea, respectively, the oil film appreciating devices appreciating edges of an oil film of the spillage oil on the sea to produce oil edge appreciating signals, respectively, the radio transmitters transmitting arrival signals every time when the radio transmitters are supplied with the oil edge appreciating signals, respectively; (B) connecting the electric power devices to the driving devices, the oil film appreciating devices, and the radio transmitters, respectively; (C) dropping the first through the N-th searching boats on the oil film on the sea to drive the first through the N-th searching boats in the first through the N-th directions, respectively; (D) preparing a direction finding device and a distance measuring device; (E) receiving, in the direction finding device, the arrival signals to find directions of the first through the N-th searching boats relative to the direction finding device; and (F) receiving, in the distance measuring device, the arrival signals to measure distances from the first through the N-th searching boats to the distance measuring device.

According to a fourth aspect of this invention, there is provided a method which searches a spillage oil and which comprises the steps of (A) preparing first through N-th searching boats having searching systems which comprise driving devices, oil film appreciating devices, boat position signal generating devices, radio transmitters connected to the oil film appreciating devices and to the boat position signal generating devices, and electric power devices, respectively, where N represents an integer greater than two, the driving devices driving the first through the N-th searching boats in first through N-th directions on the sea, respectively, the oil film appreciating devices appreciating edges of an oil film of the spillage oil on the sea to produce oil edge appreciating signals, respectively, the boat position signal generating devices supplied with a position signal from a global positioning satellite for generating boat position signals representing positions of the searching boats, respectively, the radio transmitters transmitting arrival signals every time when the radio transmitters are supplied with the oil edge appreciating signals, respectively, the radio transmitters transmitting the boat position signals when the radio transmitters are supplied with the boat position signals, respectively; (B) connecting the electric power devices to the driving devices, the oil film appreciating devices, the boat position signal generating devices, and the radio transmitters, respectively; (C) dropping the first through the N-th searching boats on the oil film on the sea to drive the first through the N-th searching boats in the first through the N-th directions, respectively; (D) preparing a radio receiving device; and (E) receiving, in the radio receiving device, the arrival signals and the boat position signals.

According to a fifth aspect of this invention, there is a method which searches a spillage oil and which comprises the steps of (A) preparing first through N-th searching boats having searching systems which comprise driving devices, oil film appreciating devices connected to the driving devices, radio transmitters connected to the oil appreciating devices, and electric power devices, respectively, where N represents an integer greater than two, the driving devices, driving the first through the N-th searching boats in first through N-th forward directions on the sea as first through N-th forward mode drivings when the driving devices are supplied with start signals, respectively, and for driving the first through the N-th searching boats in first through N-th backward directions opposite to the first through the N-th forward directions on the sea as first through N-th backward mode driving when the driving devices are supplied with the oil edge appreciating signals, respectively, the driving devices further alternatingly carrying out the first through the N-th forward and backward mode drivings every time when the driving devices are supplied with the oil edge appreciating signals, respectively, the oil film appreciating devices appreciating edges of an oil film of the spillage oil on the sea to produce the oil edge appreciating signals and supply the oil edge appreciating signals to the driving devices, respectively, the radio transmitters transmitting arrival signals every time when the radio transmitters are supplied with the oil edge appreciating signals, respectively; (B) connecting the electric power devices to the driving devices, the oil film appreciating devices, and the radio transmitters to supply the start signals to the driving devices, respectively; (C) dropping the first through the N-th searching boats on the oil film on the sea to driving the first through the N-th searching boats in the first through the N-th forward directions, respectively; (D) preparing a direction finding device and a distance measuring device; (E) receiving, in the direction finding device, the arrival signals to find directions of the first through the N-th searching boats relative to the direction finding device; and (F) receiving, in the distance measuring device, the arrival signals to measure distances from the first through the N-th searching boats to the distance measuring device.

According to a sixth aspect of this invention, there is provided a method which searches a spillage oil and which comprises the steps of (A) preparing first through N-th searching boats having searching systems which comprise driving devices, oil film appreciating devices connected to the driving devices, boat position signal generating devices, radio transmitters connected to the oil film appreciating devices and to the boat position signal generating devices, and electric power devices, respectively, where N represents an integer greater than two, the driving devices driving the first through the N-th searching boats in first through N-th forward directions on the sea as first through N-th forward mode drivings when the driving devices are supplied with start signals, respectively, and for driving the first through the N-th searching boats in first through N-th backward directions opposite to the first through the N-th forward directions on the sea as first through N-th backward mode drivings when the driving devices are supplied with the oil edge appreciating signals, respectively, the driving devices further alternatingly carrying out the first through the N-th forward and backward mode drivings every time when the driving devices are supplied with the oil edge appreciating signals, respectively, the oil film appreciating devices appreciating edges of an oil film of the spillage oil on the sea to produce the oil edge appreciating signals and supply the oil edge appreciating signals to the driving devices, respectively, the boat position signal generating devices supplied with a position signal from a global positioning satellite for generating boat position signals representing positions of the searching boats, respectively, the radio transmitters transmitting arrival signals every time when the radio transmitters are supplied with the oil edge appreciating signals, respectively, the radio transmitters transmitting the boat position signals when the radio transmitters are supplied with the boat position signals, respectively; (B) connecting the electric power devices to the driving devices, the oil film appreciating devices, the boat position generating devices, and the radio transmitters, respectively; (C) dropping the first through the N-th searching boats on the oil film on the sea to drive the first through the N-th searching boats in the first through the N-th forward directions, respectively; (D) preparing a radio receiving device; and (E) receiving, in the radio receiving device, the arrival signals and the boat position signals.

DESCRIPTION OF THE PREFERRED EMBODIMENTS

Figure 1:
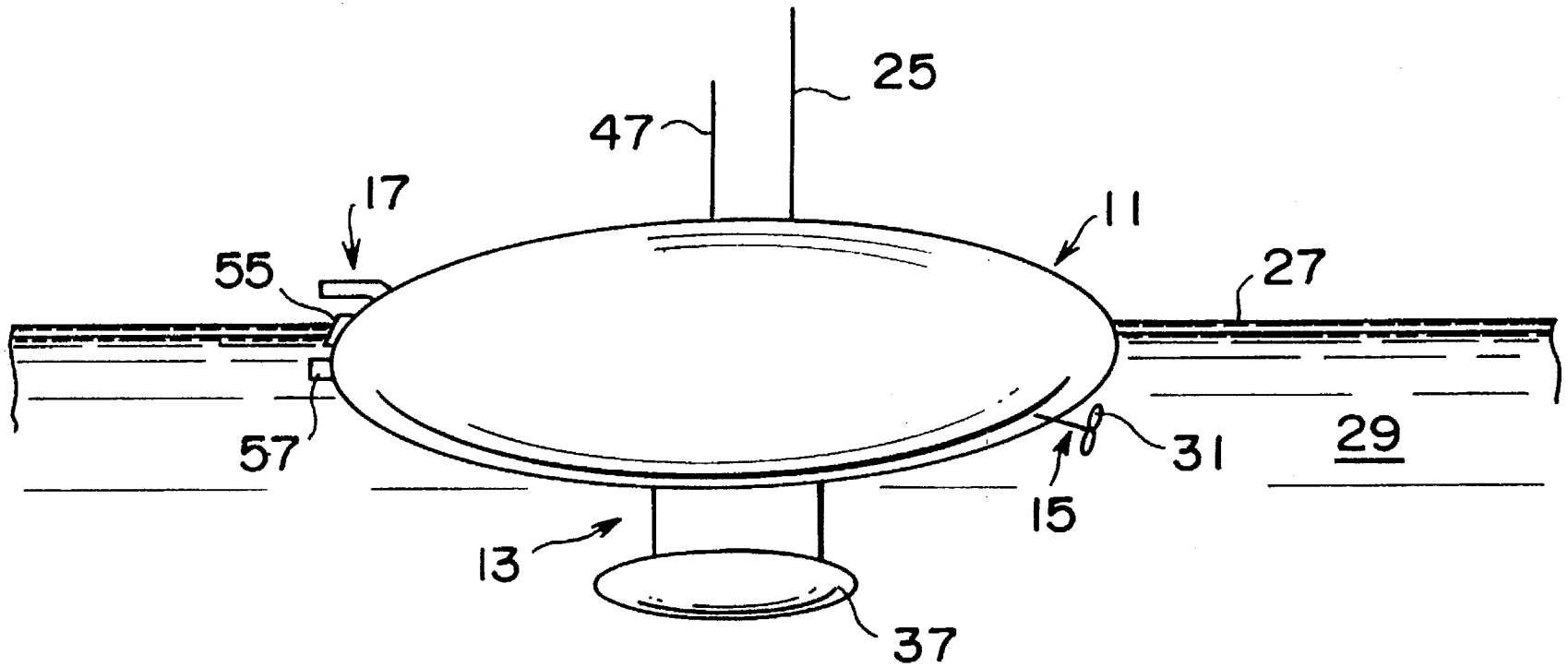
FIG. 1 is a schematic side view of a searching boat according to a first embodiment of this invention.
Figure 2:
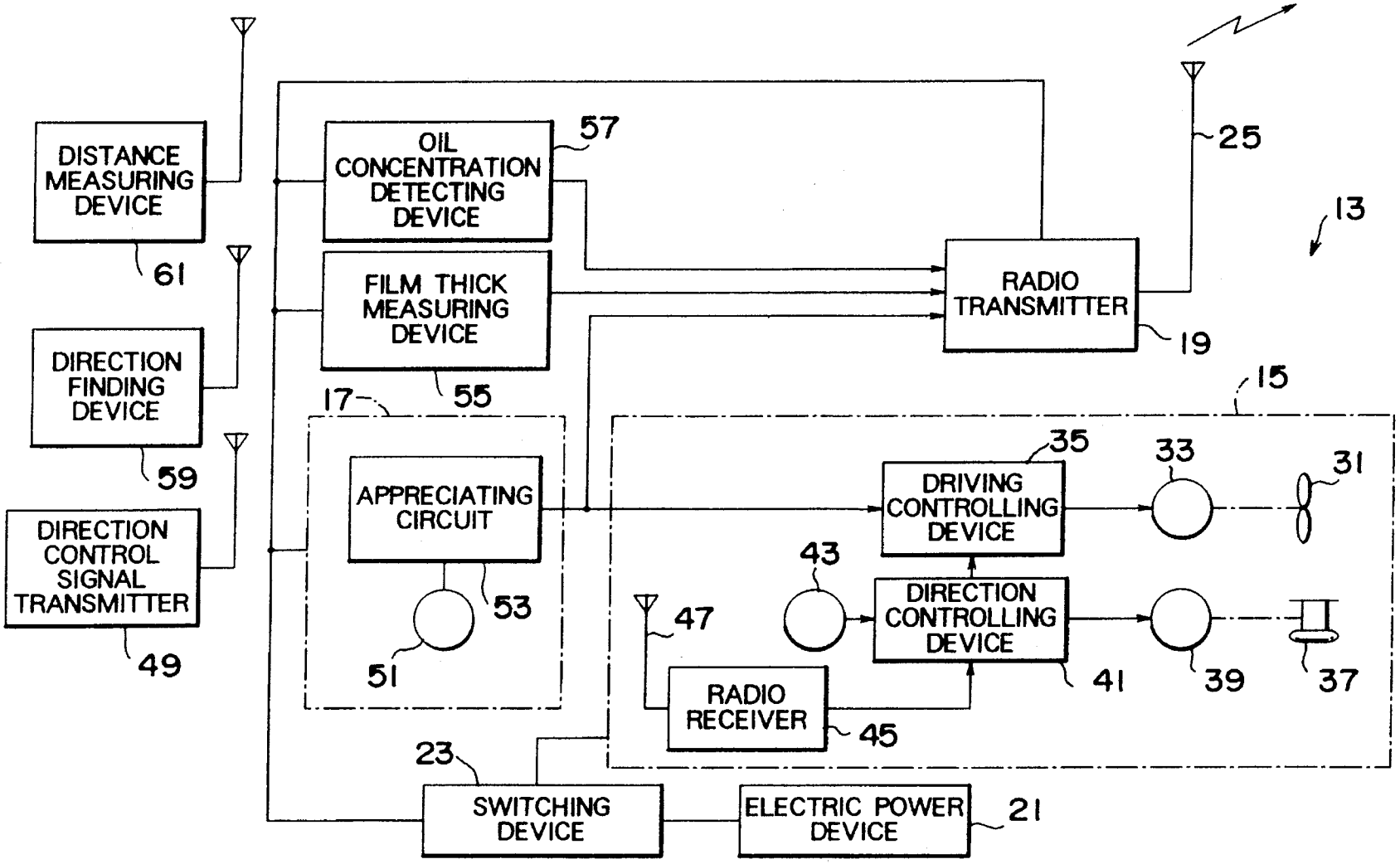
FIG. 2 is a block diagram of the searching boat illustrated in FIG. 1.

Referring to FIGS. 1 and 2, the description will proceed to a searching boat according to a first embodiment of this invention.

The searching boat 11 has a searching system 13 which comprises a driving device 15, an oil film appreciating device 17, a radio transmitter 19, and an electric power device 21. The electric power device 21 is connected to the driving device 15, the oil appreciating device 17, and the radio transmitter 19 through a switching device 23 manually operated by an operator. The radio transmitter 19 has a transmitting antenna 25. The searching boat 11 is dropped on an oil film of a spillage oil 27 on the sea 29. For example, the searching boat 11 has a length of 100 cm.

The driving device 15 is mounted on the searching boat 11. The driving device 15 drives the searching boat 11 in a predetermined direction. The driving device 15 comprises a screw 31, a driving motor 33, a driving controlling device 35, a rudder 37, a rudder controlling motor 39, a direction controlling device 41, and a direction sensor 43. The driving motor 33 is connected to the screw 31 and rotates the screw 33 in a predetermined direction. The driving controlling device 35 is connected to the driving motor 33 and controls the driving motor 33. The driving controlling device 35 stops operation of the driving motor 33 when the driving controlling device 35 is supplied with an oil edge appreciating signal from the appreciating device 17.

The rudder controlling motor 39 is connected to the rudder 37 and the direction controlling device 41. When the rudder controlling motor 39 is supplied with a direction control signal from the direction controlling device 41, the rudder controlling motor 39 moves the rudder 37 in response to the direction control signal so that the driving device 15 drives the searching boat in the predetermined direction on the oil film of the spillage oil 37 on the sea 29. The direction controlling device 41 is connected to the direction sensor 43 and the driving controlling device 35. The direction sensor 43 senses a direction in which the searching boat 11 is driving by the driving device 15 to produce a direction sensing signal. The direction controlling device 41 is supplied with the direction sensing signal from the direction sensor 43 to produce the direction control signal by comparing the direction sensing signal with a predetermined direction signal representing the predetermined direction in which the searching boat 11 is driven by the driving device 15.

The searching system 13 may have a radio receiver 45 having a first receiving antenna 47 which is supplied with a transmitter direction control signal from a direction control signal transmitter 49. The direction control signal transmitter 49 is mounted on a searching ship (not shown) or a searching plane (not shown). In this event, when the radio receiver 45 is supplied with the transmitter direction control signal through the first receiving antenna 47, the radio receiver 45 supplies the transmitted direction signal to the direction controlling device 41 as a received direction control signal. When the direction controlling device 41 is supplied with the received direction control signal from the radio receiver 45, the direction controlling device 41 produces the direction control signal in response to the received direction control signal. As a result, the rudder controlling motor 39 controls the rudder 37 in response to the direction control signal to change the predetermined direction in which the searching boat 11 is driven.

The oil film appreciating device 17 comprises an oil film sensor 51 and an oil film appreciating circuit 53 connected to the oil film sensor 51, the radio transmitter 19, and the driving controlling device 35. The oil film sensor 51 may be implemented by an optical detector or an oil concentration detector which detects an oil concentration of a gas caused from the oil film of the spillage oil 27. The oil film sensor 51 senses the oil film of the spillage oil 27 on the sea 29 to produce an oil film sensing signal and supply the oil film sensing signal to the oil film appreciating circuit 53. The oil film appreciating circuit 53 is supplied with the oil film sensing signal to appreciate an edge of the oil film of the spillage oil and produce the oil edge appreciating signal. The oil film appreciating circuit 53 supplies the oil edge appreciating signal to the radio transmitter 19 and the driving controlling device 35. The radio transmitter 19 transmits an arrival signal when the radio transmitter 19 is supplied with the oil edge appreciating signal from the oil film appreciating circuit 53.

The searching system 13 further comprises a film thick measuring device 55. The film thick measuring device 55 is connected to the electric power device 21 through the switching device 23. The film thick measuring device 55 measures a thickness of the oil film of the spillage oil 27 to produce a film thickness signal. The film thick measuring device 55 is connected to the radio transmitter 19 and supplies the film thickness signal to the radio transmitter 19. When the radio transmitter 19 is supplied with the film thickness signal from the film thick measuring device 55, the radio transmitter 19 transmits the film thickness signal through the transmitting antenna 25.

The searching system 13 further comprises an oil concentration detecting device 57. The oil concentration detecting device 57 is connected to the electric power device 21 through the switching device 23. The oil concentration detecting device 57 detects a concentration of oil in sea water under the oil film of the spillage oil 27 to produce an oil concentration signal. The oil concentrated detecting device 57 is connected to the radio transmitter 19 and supplies the oil concentration signal to the radio transmitter 19. When the radio transmitter 19 is supplied with the oil concentration signal from oil concentration detecting device 57, the radio transmitter 19 transmits the oil concentration signal through the transmitting antenna 25.

A direction finding device 59 and a distance measuring device 61 are mounted on the searching ship or the searching plane. The direction finding device 59 is supplied with the arrival signal from the radio transmitter 19 and find a direction of the searching boat 11 relative to the direction finding device 59. The distance measuring device 61 is supplied with the arrival signal from the radio transmitter 19 and measures a distance from the searching boat 11 to the distance measuring device 61.

Figure 3:
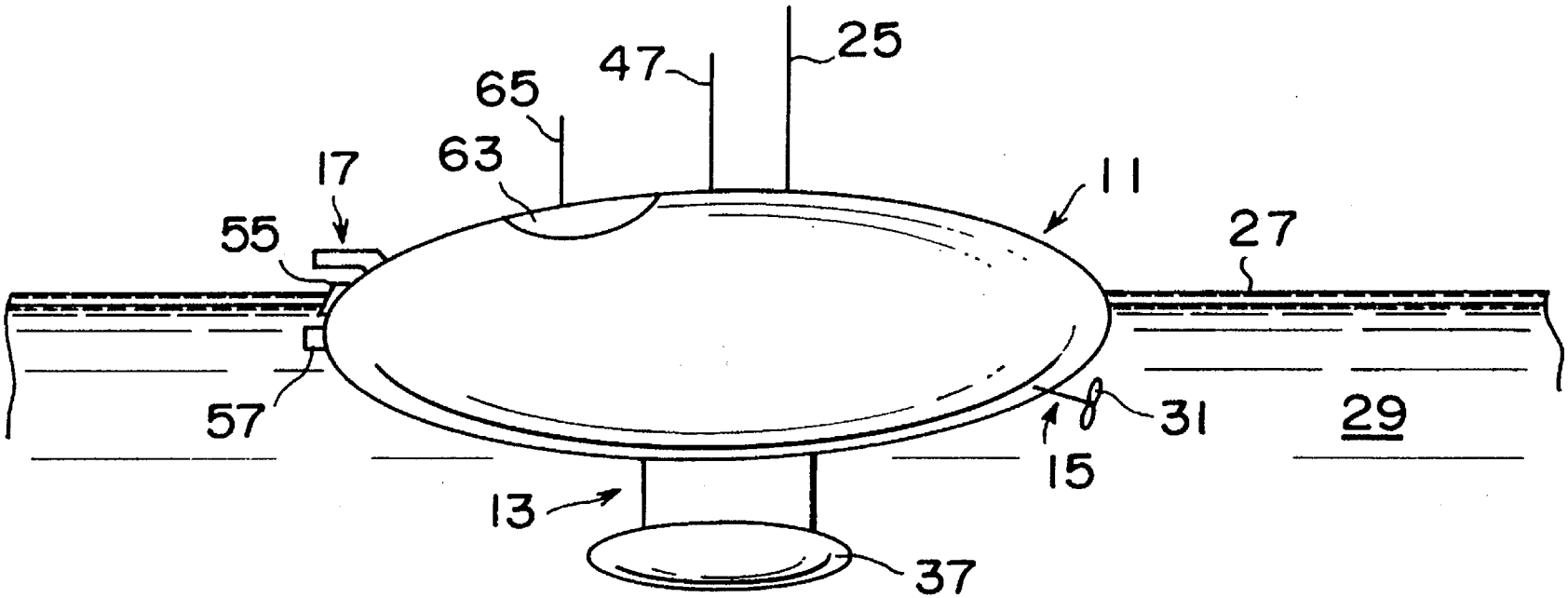
FIG. 3 is a schematic side view of a searching boat according to a second embodiment of this invention.
Figure 4:
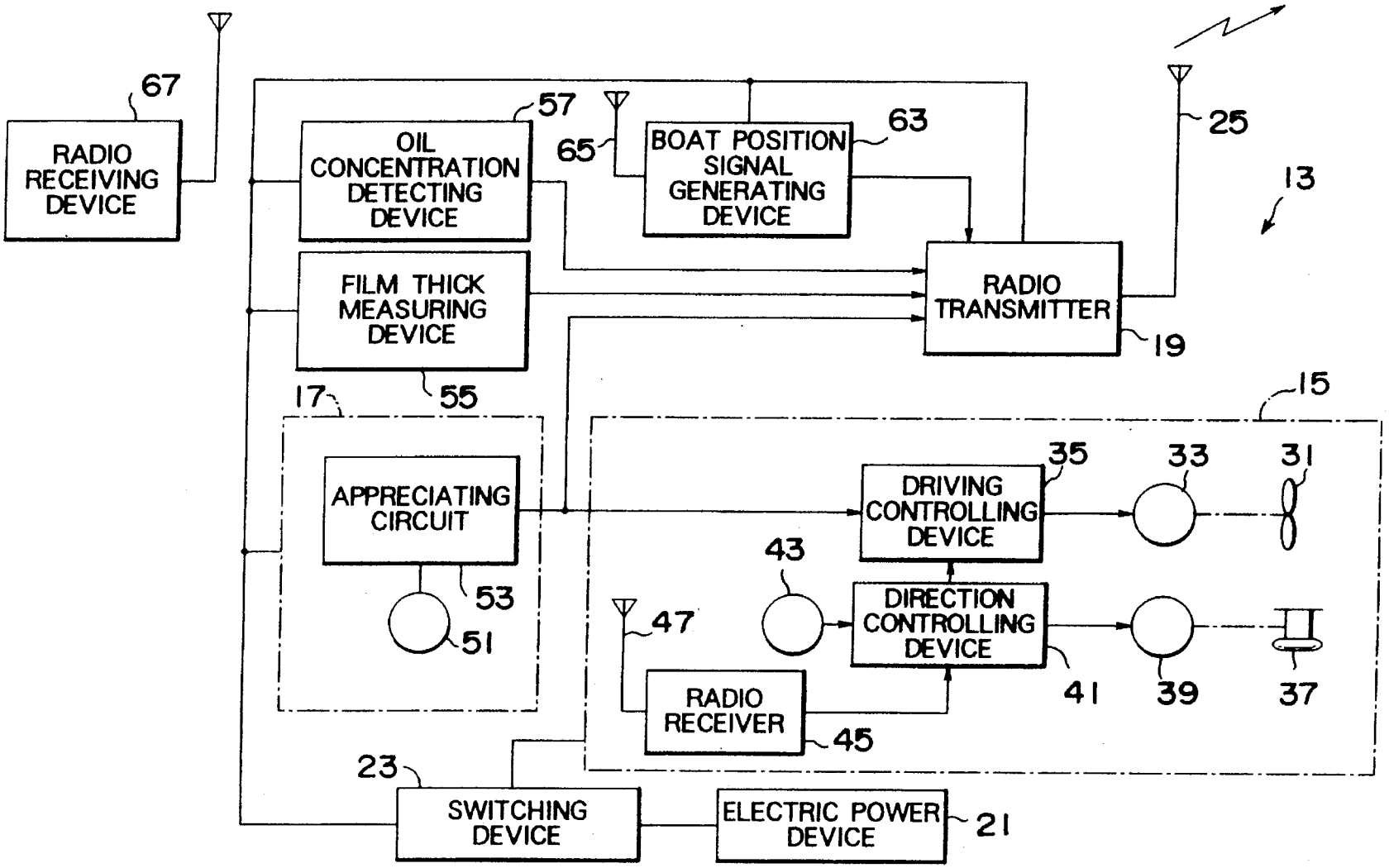
FIG. 4 is a block diagram of the searching boat illustrated in FIG. 3.

Referring to FIGS. 3 and 4, the description will proceed to a searching boat according to a second embodiment of this invention. Similar parts are designated by like reference numerals.

The searching system 13 further comprises a boat position signal generating device 63 having a second receiving antenna 65. The boat position signal generating device 63 is connected to the electric power device 21 through the switching device 23. The boat position signal generating device 63 is supplied with a position signal from a global positioning satellite (not shown). The boat position signal generating device 63 produces, in response to the position signal, a boat position signal representing a position of the searching boat 11, namely, a latitude and a longitude of the position of the searching boat 11. The boat position signal generating device 63 is connected to the radio transmitter 19 and supplies the boat position signal to the radio transmitter 19. When the radio transmitter 19 is supplied with the boat position signal from the boat position signal generating device 63, the radio transmitter 19 transmits the boat position signal through the transmitting antenna 25.

In this event, a radio receiving device 67 is mounted on the searching ship or the searching plane. The radio receiving device 67 is supplied with the arrival signals and the boat position signal.

In FIGS. 1 to 4, the searching system 11 may comprise the driving device 15 for driving the searching boat 11 in a forward direction on the oil film of the spillage oil 27 on the sea 29 as a forward mode driving when the driving device 15 is supplied with a start signal and for driving the searching boat 11 in a backward direction opposite to the forward direction on the oil film of the spillage oil 27 on the sea 29 as a backward mode driving when the driving device 15 is supplied with the oil edge appreciating signal, the driving device 15 further alternatingly carrying out the forward mode driving and the backward mode driving every time when the driving device 15 is supplied with the oil edge appreciating signal. In this event, when the electric power device 15 is connected to the driving device 15 through the switching device 23, the electric power device 15 supplies the start signal to the driving device 15. In this event, the searching system 13 may further comprise at least one of the radio receivers 45, the film thickness measuring devices 55, and the oil concentration detecting devices 57.

Figures 5A, 5B, 5C:
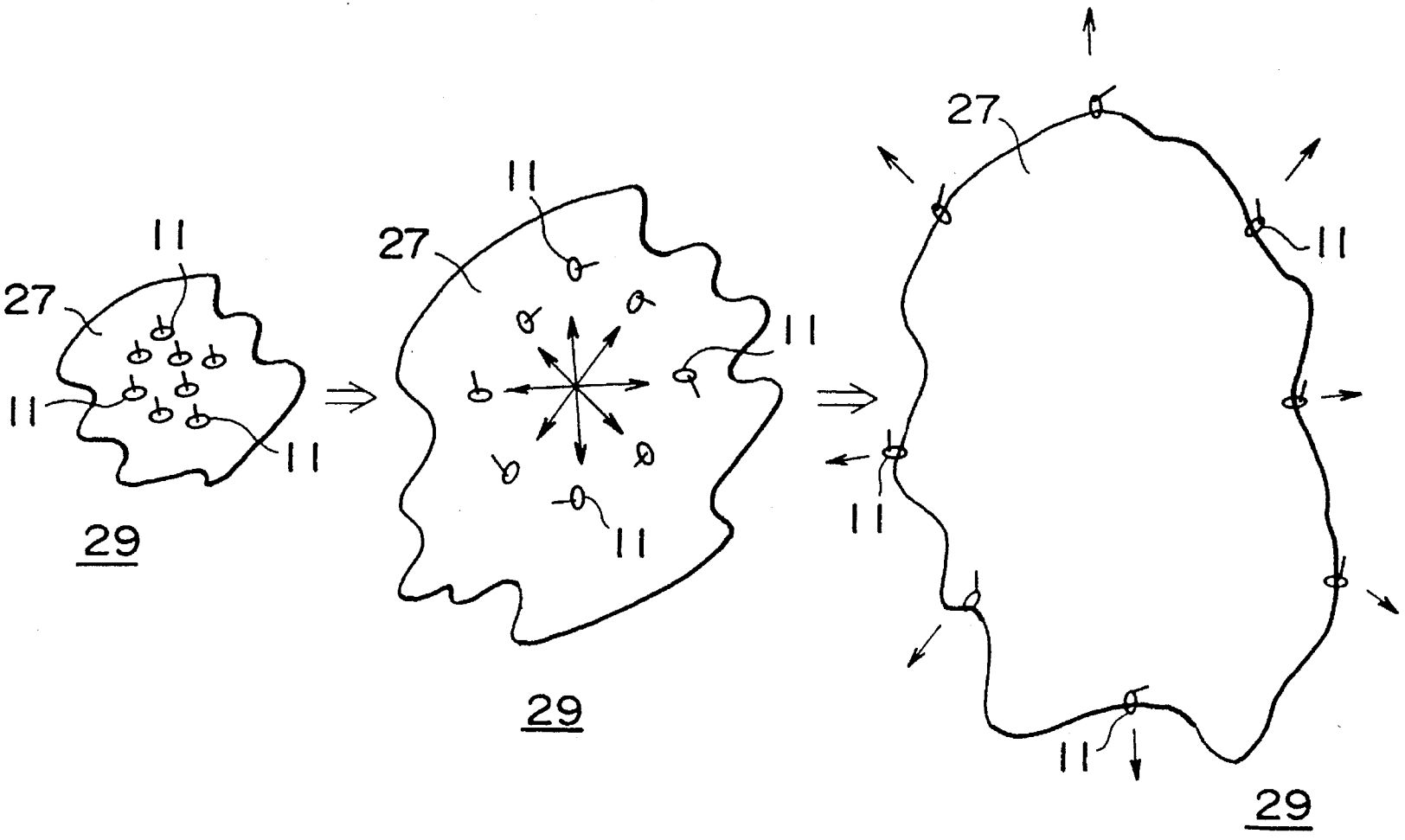
FIGS. 5(*a*) to (*c*) are views for use in describing methods according to third and fourth embodiments of this invention.

Referring to FIG. 5 together with FIGS. 1 and 2, the description will proceed to a method according to a third embodiment of this invention. Similar parts are designated by like reference numerals.

This method comprises a step of preparing first through N-th searching boat 11 having searching systems 13 which comprise the driving devices 15, the oil film appreciating devices 17, the radio transmitters 19, the electric power devices 21, and the switching devices 23, respectively, where N represents an integer greater than two. The electric power devices 21 are connected to the driving devices 15, the oil film appreciating devices 17, and the radio transmitters 19 through switching devices 23 which are manually operated by the operator.

Next, as shown in FIG. 5(*a*), the first through the N-th searching boats 11 are dropped on the oil film of the spillage oil 27 on the sea 29 and are driven in first through N-th directions by the driving devices 15, respectively, as shown in FIG. 5(*b*).

Next, as shown in FIG. 5(*c*), when the first through the N-th searching boats 11 arrive at edges of the oil film of the spillage oil 27 on the sea 29, the oil film appreciating devices 17 (FIGS. 1 and 2) appreciate the edges of the oil film of the spillage oil 27 on the sea 29 to produce the oil edge appreciating signals, respectively.

In this event, the direction finding device 59 (FIG. 2) and the distance measuring device 61 (FIG. 2) are prepared on the searching ship or the searching plane. The direction finding device 59 is supplied with the arrival signals and finds directions of the first through the N-th searching boats 11 relative to the direction finding device 59. The distance measuring device 61 is supplied with the arrival signals and measures distances from the first through the N-th boats 11 to the distance measuring device 61. In this method, the searching system 13 may further comprise at least one of the radio receivers 45, the film thick measuring devices 55, and the oil concentration detecting devices 57.

Referring to FIG. 5 together with FIGS. 3 and 4, the description will proceed to a method according to a fourth embodiment of this invention. Similar parts are designated by like reference numerals.

This method comprises a step of preparing the first through the N-th searching boats 11 having the searching systems 13 which comprise the driving devices 15, the oil film appreciating devices 17, the boat position signal generating devices 63, the radio transmitters 19, the electric power devices 21, and switching devices 23, respectively. The electric power devices 21 are connected to the driving devices 15, the oil film appreciating devices 17, the boat position signal generating devices 63, and the radio transmitters 19 through the switching devices 23 which are manually operated by the operator.

Next, as shown in FIG. 5(*a*), the first through the N-th searching boats 11 are dropped on the oil film of the spillage oil 27 on the sea 29 and are driven in the first through the N-th directions by the driving devices 15, respectively, as shown in FIG. 5(*b*).

Next, as shown in FIG. 5(*c*), when the first through the N-th searching boats 11 arrive at edges of the oil film of the spillage oil 27 on the sea 29, the oil film appreciating devices 17 (FIGS. 3 and 4) appreciate the edges of the oil film of the spillage oil 27 on the sea 29 to produce the oil edge appreciating signals, respectively.

In this event, the radio receiving device 67 (FIG. 4) is prepared on the searching ship or the searching plane. The radio receiving device 67 is supplied with the arrival signals and the boat position signals. In this method, the searching system 13 may further comprise at least one of the radio receivers 45, the film thick measuring devices 55, and the oil concentration detecting devices 57.

Figures 6A, 6B, 6C:
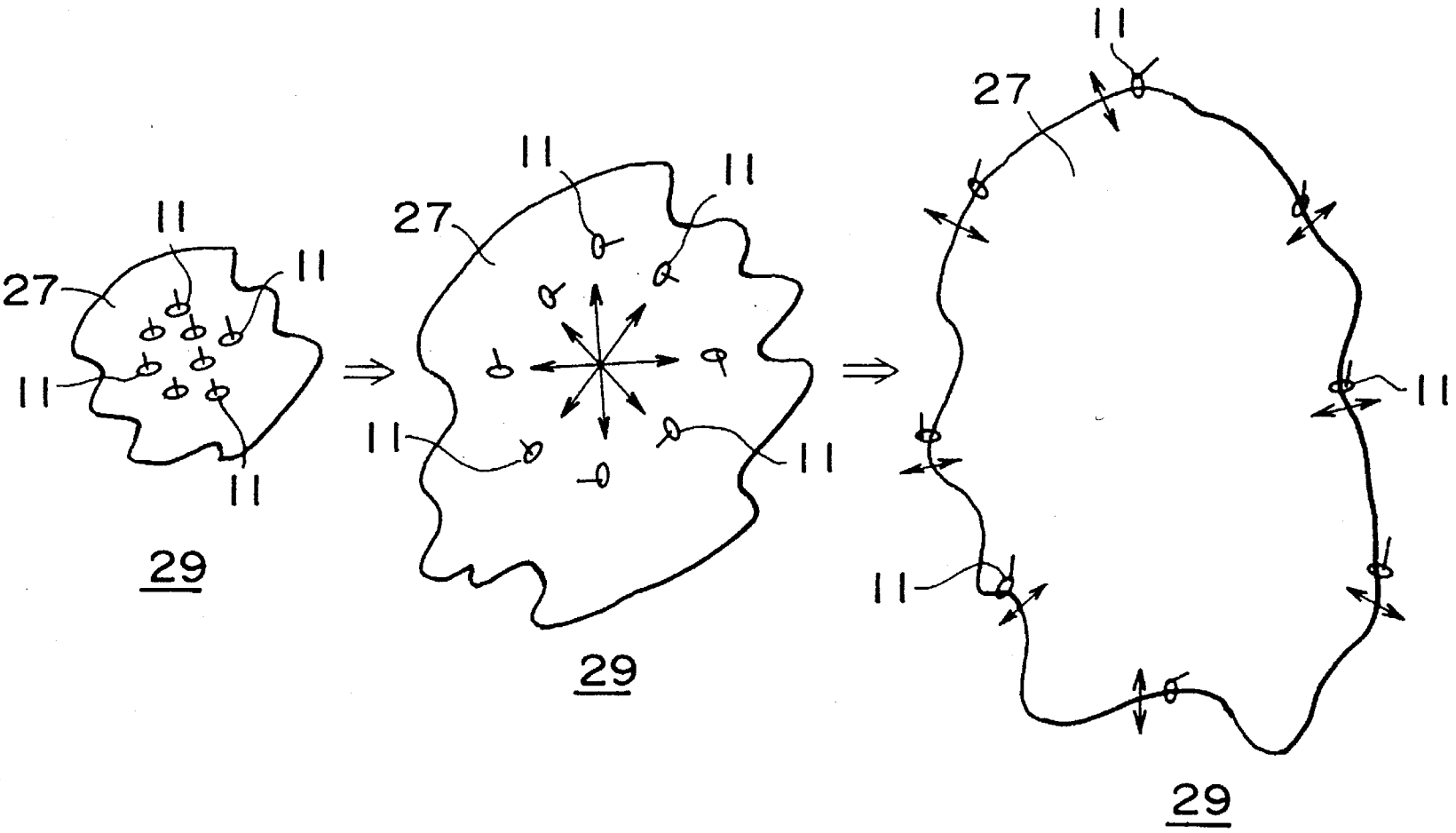
FIGS. 6(*a*) to (*c*) are views for use in describing methods according to fifth and sixth embodiments of this invention.

Referring to FIG. 6 together with FIGS. 1 and 2, the description will proceed to a method according to a fifth embodiment of this invention. Similar parts are designated by like reference numerals.

This method comprises a step of preparing the first through the N-th searching boats 11 having searching systems 13 which comprise the driving devices 15, the oil film appreciating devices 17, the radio transmitters 19, the electric power devices 21, and the switching devices 23, respectively, the driving devices 15 driving and first through the N-th searching boats 11 in first through N-th forward directions on the sea 29 as first through N-th forward mode drivings when the driving devices 15 are supplied with start signals, respectively, and for driving the first through the N-th searching boats 11 in first through N-th backward directions opposite to the first through N-th forward directions on the sea 29 as first through N-th backward mode drivings when the driving devices 15 are supplied with the oil edge appreciating signals, respectively, the driving devices 15 further alternatingly carrying out the first through the N-th forward and backward mode drivings every time when the driving devices are supplied with the oil edge appreciating signals, respectively, the radio transmitters 19 transmitting arrival signals every time when the radio transmitters are supplied with the oil edge appreciating signals, respectively.

Next, the electric power devices 21 are connected to the driving devices, the oil film appreciating devices 17, and radio transmitters 19 to supply the start signals to the driving devices 15, respectively.

Next, as shown in FIG. 6(*a*), the first through the N-th searching boats 11 are dropped on the oil film of the spillage oil 27 on the sea 29 and are drive in the first through the N-th forward directions by the driving devices 15 as the forward mode drivings, respectively, as shown in FIG. 6(*b*).

Next, as shown in FIG. 6(*c*), when the first through the N-th searching boats 11 arrive at edges of the oil film of the spillage oil 27 on the sea 29, the oil film appreciating devices 17 (FIGS. 1 and 2) appreciate the edges of the oil film of the spillage oil 27 on the sea 29 to produce the arrival signals, respectively. When the driving devices 15 are supplied with the oil edge appreciating signals, the driving devices 15 drive the first through the N-th searching boats 11 in the first through the N-th backward directions as the backward mode drivings, respectively. Furthermore, the driving devices 15 alternatingly carry out the forward mode drivings and the backward mode drivings every time when the driving devices 15 are supplied with the oil edge appreciating signals, respectively.

In this event, the direction finding device 59 (FIG. 2) and the distance measuring device 61 (FIG. 2) are prepared on the searching ship or the searching plane. The direction finding device 59 is supplied with the arrival signals and finds the directions of the first through the N-th searching boats 11 relative to the direction finding device 59. The distance measuring device 61 is supplied with the arrival signals and measures the distances from the first through the N-th boats 11 to the distance measuring device 61. In this method, the searching system 13 may further comprise at least one of the radio receivers 45, the film thick measuring devices 55, and the oil concentration detecting devices 57.

Referring to FIG. 6 together with FIGS. 3 and 4, the description will proceed to a method according to a sixth embodiment of this invention. Similar parts are designated by like reference numerals.

This method comprises a step of preparing the first through the N-th searching boats 11 having searching systems 13 which comprise the driving devices 15, the oil film appreciating devices 17, the boat position generating devices 63, the radio transmitters 19, the electric power devices 21, and the switching devices 23, respectively, the driving devices 15 driving the first through the N-th searching boats 11 in the first through the N-th forward directions on the sea 29 as the first through the N-th forward mode drivings when the driving devices 15 are supplied with the start signals, respectively, and for driving the first through the N-th searching boats 11 in the first through the N-th backward directions opposite to the first through the N-th forward directions on the sea 29 as the first through the N-th backward mode drivings when the driving devices 15 are supplied with the oil edge appreciating signals, respectively, the driving devices 15 further alternatingly carrying out the first through the N-th forward and backward mode drivings ever time when the driving devices 15 are supplied with the oil edge appreciating signals, respectively, the radio transmitters 19 transmitting the arrival signals every time when the time transmitters 19 are supplied with the oil edge appreciating signals, respectively.

Next, the electric power devices 21 are connected to the driving devices 15, the oil film appreciating devices 17, the boat position signal generating devices 63, and radio transmitters 19 to supply the start signals to the driving devices 15, respectively.

Next, as shown in FIG. 6(*a*), the first through the N-th searching boats 11 are dropped on the oil film of the spillage oil 27 on the sea 29 and are driven in the first through the N-th forward directions by the driving devices 15 as the forward mode drivings, respectively, as shown in FIG. 6(*b*).

Next, as shown in FIG. 6(*c*), when the first through the N-th searching boats 11 arrive at edges of the oil film of the spillage oil 27 on the sea 29, the oil film appreciating devices 17 (FIGS. 3 and 4) appreciate the edges of the oil film of the spillage oil 27 on the sea 29 to produce the arrival signals, respectively. When the driving devices 15 are supplied with the oil edge appreciating signals, the driving devices 15 drive the first through the N-th searching boats 11 in the first through the N-th backward directions as the backward mode drivings, respectively. Furthermore, the driving devices 15 alternatingly carry out the forward mode drivings and the backward mode drivings every time when the driving devices 15 are supplied with the oil edge appreciating signals, respectively.

In this event, the radio receiving device 67 (FIG. 4) is prepared on the searching ship or the searching plane. The radio receiving device 67 is supplied with the arrival signals and the boat position signals. In this method, the searching system 13 may further comprise at lest one of the radio receivers 45, the film thick measuring device 55, and the oil concentration detecting devices 57.

What is claimed is:

1. A searching boat having a searching system for searching a spillage oil on the sea, said searching system comprising:

a driving device for driving said searching boat in a predetermined direction on the sea;

an oil film appreciating device for appreciating an edge of an oil film of said spillage oil on the sea to produce an oil edge appreciating signal;

a radio transmitter connected to said oil film appreciating device for transmitting an arrival signal when said radio transmitter is supplied with said oil edge appreciating signal; and an electric power device connected to said driving device, said oil film appreciating device, and said radio transmitter.

2. A searching boat as claimed in claim 1, wherein said searching system further comprises a boat position signal generating device supplied with a position signal from a global positioning satellite for generating a boat position signal representing a position of said searching boat, said radio transmitter supplied with said boat position signal for transmitting said boat position signal.

3. A searching boat as claimed in claim 2, wherein said searching system further comprises a radio receiver supplied with a direction control signal for sending said direction control signal and a direction controlling device supplied with said direction control signal for controlling said driving device to change a driving direction in which said driving device drives said searching boat on the sea.

4. A searching boat as claimed in claim 3, wherein said searching system further comprises a film thick measuring device for measuring a thickness of said oil film to produce a film thickness signal, said radio transmitter supplied with said film thickness signal for transmitting said film thickness signal.

5. A searching boat as claimed in claim 4, wherein said searching system further comprises an oil concentration detecting device for detecting a concentration of oil in sea water under said oil film to produce an oil concentration signal, said radio transmitter supplied with said oil concentration signal for transmitting said oil concentration signal.

6. A searching boat as claimed in claim 1, wherein said searching system further comprises a radio receiver supplied with a direction control signal for sending said direction control signal and a direction controlling device supplied with said direction control signal or controlling said driving device to change a driving direction in which said driving device drives said searching boat on the sea.

7. A searching boat as claimed in claim 6, wherein said searching system further comprises a film thick measuring device for measuring a thickness of said oil film to produce a film thickness signal, said radio transmitter supplied with said film thickness signal for transmitting said film thickness signal.

8. A searching boat as claimed in claim 7, wherein said searching system further comprises an oil concentration detecting device for detecting a concentration of oil in sea water under said oil film to produce an oil concentration signal, said radio transmitter supplied with said oil concentration signal for transmitting said oil concentration signal.

9. A searching boat as claimed in claim 1, wherein said searching system further comprises a film thick measuring device for measuring a thickness of said oil film to produce a film thickness signal, said radio transmitter supplied with said film thickness signal for transmitting said film thickness signal.

10. A searching boat as claimed in claim 9, wherein said searching system further comprises an oil concentration detecting device for detecting a concentration of oil in sea water under said oil film to produce an oil concentration signal, said radio transmitter supplied with said oil concentration signal for transmitting said oil concentration signal.

11. A searching boat as claimed in claim 1, wherein said searching system further comprises an oil concentration detecting device for detecting a concentration of oil in sea water under said oil film to produce an oil concentration signal, said radio transmitter supplied with said oil concentration signal for transmitting said oil concentration signal.

12. A searching boat having a searching system for searching a spillage oil on the sea, said searching system comprising:

a driving device for driving said searching boat in a forward direction on the sea as a forward mode driving when said driving device is supplied with a start signal and for driving searching boat in a backward direction opposite to said forward direction on the sea as a backward mode driving when said driving device is supplied with an oil edge appreciating signal, said driving device further alternatingly carrying out said forward mode driving and said backward mode driving every time when said driving device is supplied with said oil edge appreciating signal;

an oil film appreciating device for appreciating an edge of an oil film of said spillage oil on the sea to produce said oil edge appreciating signal;

a radio transmitter connected to said oil film appreciating device for transmitting an arrival signal when said radio transmitter is supplied with said oil edge appreciating signal; and an electric power device connected to said driving device, said oil film appreciating device, and said radio transmitter to supply said start signal to said driving device.

13. A searching boat as claimed in claim 12, wherein said searching system further comprises a boat position signal generating device supplied with a position signal from a global positioning satellite for generating a boat position signal representing a position of said searching boat, said radio transmitter supplied with said boat position signal for transmitting said boat position signal.

14. A searching boat as claimed in claim 13, wherein said searching system further comprises a radio receiver supplied with a direction control signal for sending said direction control signal and a direction controlling device supplied with said direction control signal for controlling said driving device to change a driving direction in which said driving device drives said searching boat on the sea.

15. A searching boat as claimed in claim 14, wherein said searching system further comprises a film thick measuring device for measuring a thickness of said oil film to produce a film thickness signal, said radio transmitter supplied with said film thickness signal for transmitting said film thickness signal.

16. A searching boat as claimed in claim 15, wherein said searching system further comprises an oil concentration detecting device for detecting a concentration of oil in sea water under said oil film to produce an oil concentration signal, said radio transmitter supplied with said oil concentration signal for transmitting said oil concentration signal.

17. A searching boat as claimed in claim 12, wherein said searching system further comprises a radio receiver supplied with a direction control signal for sending said direction control signal and a direction controlling device supplied with said direction control signal for controlling said driving device to change a driving direction in which said driving device drives said searching boat on the sea.

18. A searching boat as claimed in claim 17, wherein said searching system further comprises a film thick measuring device for measuring a thickness of said oil film to produce a film thickness signal, said radio transmitter supplied with said film thickness signal for transmitting said film thickness signal.

19. A searching boat as claimed in claim 18, wherein said searching system further comprises an oil concentration detecting device for detecting a concentration of oil in sea water under said oil film to produce an oil concentration signal, said radio transmitter supplied with said oil concentration signal for transmitting with said oil concentration signal.

20. A searching boat as claimed in claim 12, wherein said searching system further comprises a film thick measuring device for measuring a thickness of said oil film to produce a film thickness signal, said radio transmitter supplied with said film thickness signal for transmitting said film thickness signal.

21. A searching boat as claimed in claim 20, wherein said searching system further comprises an oil concentration detecting device for detecting a concentration of oil in sea water under said oil film to produce an oil concentration signal, said radio transmitter supplied with said oil concentration signal for transmitting said oil concentration signal.

22. A searching boat as claimed in claim 12, wherein said searching system further comprises an oil concentration detecting device for detecting a concentration of oil in sea water under said oil film to produce an oil concentration signal, said radio transmitter supplied with said oil concentration signal for transmitting said oil concentration signal.

23. A method of searching a spillage oil, comprising the steps of:

preparing first through N-th searching boats having searching systems which comprise driving devices, oil film appreciating devices, radio transmitters connected to said oil film appreciating devices, and electric power devices, respectively, where N represents an integer greater than two, said driving devices driving said first through said N-th searching boats in first through N-th directions on the sea, respectively, said oil film appreciating devices appreciating edges of an oil film of said spillage oil on the sea to produce oil edge appreciating signals, respectively, said radio transmitters transmitting arrival signals every time when said radio transmitters are supplied with said oil edge appreciating signals, respectively;

connecting said electric power devices to said driving devices, said oil film appreciating devices, and said radio transmitters, respectively;

dropping said first through said N-th searching boats on said oil film on the sea to drive said first through said N-th searching boats in said first through said N-directions, respectively;

preparing a direction finding device and a distance measuring device;

receiving, in said direction finding device, said arrival signals to find directions of said first through said N-th searching boats relative to said direction finding device; and receiving, in said distance measuring device, said arrival signals to measure distances from said first through said N-th searching boats to said distance measuring device.

24. A method as claimed in claim 23, wherein said searching system further comprises a radio receiver supplied with a direction control signal for sending said direction control signal and a direction controlling device supplied with said direction control signal for controlling said driving device to change a driving direction in which said driving device drives said searching boat on the sea.

25. A method as claimed in claim 24, wherein said searching system further comprises a film thick measuring device for measuring a thickness of said oil film to produce a film thickness signal, said radio transmitter supplied with said film thickness signal for transmitting said film thickness signal.

26. A method as claimed in claim 25, wherein said searching system further comprises an oil concentration detecting device for detecting a concentration of oil in sea water under said oil film to produce an oil concentration signal, said radio transmitter supplied with said oil concentration signal for transmitting said oil concentration signal.

27. A method as claimed in claim 26, wherein said searching system further comprises a film thick measuring device for measuring a thickness of said oil film to produce a film thickness signal, said radio transmitter supplied with said film thickness signal for transmitting said film thickness signal.

28. A method as claimed in claim 27, wherein said searching system further comprises an oil concentration detecting device for detecting a concentration of oil in sea water under said oil film to produce an oil concentration signal, said radio transmitter supplied with said oil concentration signal for transmitting said oil concentration signal.

29. A method as claimed in claim 23, wherein said searching system further comprises an oil concentration detecting device for detecting a concentration of oil in sea water under said oil film to produce an oil concentration signal, said radio transmitter supplied with said oil concentration signal for transmitting said oil concentration signal.

30. A method of searching a spillage oil, comprising the steps of:

preparing first through N-th searching boats having searching systems which comprise driving devices, oil film appreciating devices, boat position signals generating devices, radio transmitters connected to said oil film appreciating devices and to said boat position signal generating devices, and electric power devices, respectively, where N represents an integer greater than two, said driving devices driving said first through said N-th searching boats in first through N-th directions on the sea, respectively, said oil film appreciating devices appreciating edges of an oil film of said spillage oil on the sea to produce oil edge appreciating signals, respectively, said boat position signal generating devices supplied with a position signal from a global positioning satellite for generating boat position signals representing positions of said searching boats, respectively, said radio transmitters transmitting arrival signals every time when said radio transmitters are supplied with said oil edge appreciating signals, respectively, said radio transmitters transmitting said boat position signals when said radio transmitters are supplied with said boat position signals, respectively;

connecting said electric power devices to said driving devices, said oil film appreciating devices, said boat position signal generating devices, and said radio transmitters, respectively;

dropping said first through said N-th searching boats on said oil film on the sea to drive said first through said N-th searching boats in said first through said N-th directions, respectively;

preparing a radio receiving device; and receiving, in said radio receiver device, said arrival signals and said boat position signals.

31. A method as claimed in claim 30, wherein said searching system further comprises a radio receiver supplied with a direction control signal for sending said direction control signal and a direction controlling device supplied with said direction control signal for controlling said driving device to change a driving direction in which said driving device drives said searching boat on the sea.

32. A method as claimed in claim 31, wherein said searching system further comprises a film thick measuring device for measuring a thickness of said oil film to produce a film thickness signal, said radio transmitter supplied with said film thickness signal for transmitting said film thickness signal.

33. A searching boat as claimed in claim 32, wherein said searching system further comprises an oil concentration detecting device for detecting a concentration of oil in sea water under said oil film to produce an oil concentration signal, said radio transmitter supplied with said oil concentration signal for transmitting said oil concentration signal.

34. A method of searching a spillage oil, comprising the steps of:

preparing first through N-th searching boats having searching systems which comprise driving devices, oil film appreciating devices connected to said driving devices, radio transmitters connected to said oil film appreciating devices, and electric power devices, respectively, where N represents an integer greater than two, said driving devices driving said first through said N-th searching boats in first through N-th forward directions on the sea as first through N-th forward mode drivings when said driving devices are supplied with start signals, respectively, and for driving said first through said N-th searching boats in first through N-th backward directions opposite to said first through said N-th forward directions on the sea as first through N-th backward mode drivings when said driving devices are supplied with said oil edge appreciating signals, respectively, said driving devices further alternatingly carrying out said first through said N-th forward and backward mode drivings every time when said driving devices are supplied with said oil edge appreciating signals, respectively, said oil film appreciating devices appreciating edges of an oil film of said spillage oil on the sea to produce said oil edge appreciating signals and supply said oil edge appreciating signals to said driving devices, respectively, said radio transmitters transmitting arrival signals every time when said radio transmitters are supplied with said oil edge appreciating signals, respectively;

connecting said electric power devices to said driving devices, said oil film appreciating devices, and said radio transmitters to supply said start signals to said driving devices, respectively;

dropping said first through said N-th searching boats on said oil film on the sea to drive said first through said N-th searching boats in said first through said N-th forward directions, respectively;

preparing a direction finding device and a distance measuring device;

receiving, in said direction finding device, said arrival signals to find directions of said first through said N-th searching boats relative to said direction finding device; and receiving, in said distance measuring device, said arrival signals to measure distances from said first through said N-th searching boats to said distance measuring device.

35. A method as claimed in claim 34, wherein said searching system further comprises a radio receiver supplied with a direction control signal for sending said direction control signal and a direction controlling device supplied with said direction control signal for controlling said driving device to change a driving direction in which said driving device drives said searching boat on the sea.

36. A method as claimed in claim 35, wherein said searching system further comprises a film thick measuring device for measuring a thickness of said oil film to produce a film thickness signal, said radio transmitter supplied with said film thickness signal for transmitting said film thickness signal.

37. A method as claimed in claim 36, wherein said searching system further comprises an oil concentration detecting device for detecting a concentration of oil in sea water under said oil film to produce an oil concentration signal, said radio transmitter supplied with said oil concentration signal for transmitting said oil concentration signal.

38. A method as claimed in claim 34, said searching system further comprises a film thick measuring device for measuring a thickness of said oil film to produce a film thickness signal, said radio transmitter supplied with said film thickness signal for transmitting said film thickness signal.

39. A method as claimed in claim 38, wherein said searching system further comprises an oil concentration detecting device for detecting a concentration of oil in sea water under said oil film to produce an oil concentration signal, said radio transmitter supplied with said oil concentration signal for transmitting said oil concentration signal.

40. A method as claimed in claim 34, wherein said searching system further comprises an oil concentration detecting device for detecting a concentration of oil in sea water under said oil film to produce an oil concentration signal, said radio transmitter supplied with said oil concentration signal for transmitting said oil concentration signal.

41. A method of searching a spillage oil, comprising the steps of:

preparing first through N-th searching boats having searching systems which comprise driving devices, oil film appreciating devices connected to said driving devices, boat position signal generating devices, radio transmitters connected to said oil film appreciating devices and to said boat position signal generating devices, and electric power devices, respectively, where N represents an integer greater than two, said driving devices driving said first through said N-th searching boats in first through N-th forward directions on the sea as first through N-th forward mode driving when said driving devices are supplied with start signals, respectively, and for driving said first through said N-th searching boats in first through N-th backward directions opposite to said first through said N-th forward directions on the sea as first through N-th backward mode drivings when said driving devices are supplied with said oil edge appreciating signals, respectively, said driving devices further alternatingly carrying out said first through said N-th forward and backward mode drivings every time when said driving devices are supplied with said oil edge appreciating signals, respectively, said oil film appreciating devices appreciating edges of an oil film of said spillage oil on the sea to produce said oil edge appreciating signals and supply said oil edge appreciating signals to said driving devices, respectively, said boat position signal generating devices supplied with a position signal from a global positioning satellite for generating boat position signals representing positions of said searching boats, respectively, said radio transmitters transmitting arrival signals every time when said radio transmitters are supplied with said oil edge appreciating signals, respectively, said radio transmitters transmitting said boat position signals when said radio transmitters are supplied with said boat position signals, respectively;

connecting said electric power devices to said driving devices, said oil film appreciating devices, said boat position generating devices, and said radio transmitters, respectively;

dropping said first through said N-th searching boats on said oil film on the sea to drive said first through said N-th searching boats in said first through said N-th forward directions, respectively;

preparing a radio receiving device; and receiving, in said radio receiving device, said arrival signals and said boat position signals.

42. A method as claimed in claim 41, wherein said searching system further comprises a radio receiver supplied with a direction control signal for sending said direction control signal and a direction controlling device supplied with said direction control signal for controlling said driving device to change a driving direction in which said driving device drives said searching boat on the sea.

43. A method as claimed in claim 42, wherein said searching system further comprises a film thick measuring device for measuring a thickness of said oil film to produce a film thickness signal, said radio transmitter supplied with said film thickness signal for transmitting said film thickness signal.

44. A method as claimed in claim 43, wherein said searching system further comprises an oil concentration detecting device for detecting a concentration of oil in sea water under said oil film to produce an oil concentration signal, said radio transmitter supplied with said oil concentration signal for transmitting said oil concentration signal.

* * * * *